United States Patent [19]

Hodgson

[11] Patent Number: 4,757,978

[45] Date of Patent: Jul. 19, 1988

[54] SHAPE-MEMORY ALLOY RESETTING APPARATUS

[75] Inventor: Darel E. Hodgson, Palo Alto, Calif.

[73] Assignee: CVI/Beta Ventures, Inc., Menlo Park, Calif.

[21] Appl. No.: 918,086

[22] Filed: Oct. 14, 1986

[51] Int. Cl.[4] ..... C71D 9/00

[52] U.S. Cl. ..... 266/262; 266/274; 266/287; 219/50

[58] Field of Search ..... 266/262, 258, 252, 287, 266/274; 432/58, 253; 219/50

[56] References Cited

U.S. PATENT DOCUMENTS

| | | | |
|---|---|---|---|
| 3,118,773 | 1/1964 | Bennett et al. | 99/182 |
| 3,180,636 | 4/1965 | Carpenter | 269/224 |
| 3,329,801 | 7/1967 | Shannon et al. | 219/388 |
| 3,540,718 | 11/1970 | Heffron et al. | 269/254 |
| 3,604,700 | 9/1971 | Gault | 269/288 |
| 4,054,376 | 10/1977 | Wareham | 351/178 |
| 4,249,889 | 2/1981 | Kemp | 432/11 |
| 4,283,233 | 8/1981 | Goldstein et al. | 148/11.5 R |
| 4,314,790 | 2/1982 | Metz | 414/786 |
| 4,379,725 | 4/1983 | Kemp | 148/4 |
| 4,410,373 | 10/1983 | Kemp | 148/16 |
| 4,472,035 | 9/1984 | Takamura et al. | 351/41 |
| 4,484,955 | 11/1984 | Hochstein | 148/11.5 R |
| 4,493,737 | 1/1985 | Banker | 148/11.5 R |

*Primary Examiner*—Christopher W. Brody

*Attorney, Agent, or Firm*—Burns, Doane, Swecker & Mathis

[57] ABSTRACT

Apparatus for setting and resetting a portion of a shape-memory alloy part, the apparatus including an enclosing chamber having openings for the portion, a body of solid particles in the chamber, a pressure member connected to the chamber to immobilize the particles and the portion and a mechanism for heating the portion to a resetting temperature while immobilized, is disclosed.

6 Claims, 2 Drawing Sheets

SHAPE-MEMORY ALLOY RESETTING APPARATUS

FIELD OF THE INVENTION

The present invention relates to shape-memory alloys. More particularly it relates to apparatus for resetting the shape of articles formed of shape-memory alloys. The purpose for such resetting is to conform such articles to a custom shape of varying dimensions, shapes or configurations, such as for personal wear, depending upon the feel or desired appearance of the wearer. Such resetting is also used to adapt a tool for a desired function by a user without reworking the complete article as by remolding, recasting or mechanical deformation.

It is a particular object of the invention to provide apparatus for rapidly and simply adjusting the shape or configuration of different portions of an article, such as the lens frames or temple pieces of a pair of spectacles, or other personal use or wear devices, so that only a selected portion of a standard or mass produced article need be adjusted or readjusted to conform to an individual wearer's or user's comfort or satisfaction. The apparatus is particularly characterized by means for embedding and holding within a body of particles or powder a selected portion of a shape-memory alloy article formed into any newly selected shape. The new shape is first set in the martensitic state of the alloy with the part below the transformation temperature, such as from slightly above normal room temperature to well below any temperature at which the part is to be subsequently used. With the part then physically held by pressure on the body of particles, the selected portion of the article is electrically heated in the newly selected shape to a heat-treating temperature substantially above the transformation temperature of the alloy to convert the crystalline structure of the shape-memory alloy part to its new austenitic state. Thus the portion is restrained in the selected shape during transformation of the alloy to prevent the portion from returning to any prior set austenitic, or memory state, during the time such austenitic state is being reset.

BACKGROUND OF THE INVENTION

Shape-memory alloys have found a wide variety of uses in recent years. Such alloys have two primary states which are described in the prior art as the martensitic state and the austenitic state. In the martensitic state the alloy is weaker and malleable to a predeterminable extent. In the austenitic (or memory) state the alloy is stronger or more rigidly resilient. The alloy may be readily deformed under the martensitic state but then recovers from such deformation to its initial shape upon heating above the transformation temperature to recover such deformation to its austenitic state. The temperature condition under which such states occur is predeterminable in accordance with the alloy content. The two crystalline states of the alloy are above or below a transformation temperature lying within a critical temperature range. The transformation temperature is generally determined by the percentage of the constituent components (usually nickel and titanium) of the shape-memory alloy.

The alternate states of such alloy, the relatively sharp temperature transformation between these states, and the almost limitless ability of the alloy to reverse the states, have found many novel uses. It has been proposed heretofore to use shape-memory alloy in parts or devices wherein the alloy's relatively weaker malleable state absorbs displacement or deformation forces without permanent damage to the rest of the structure or device. After undergoing such deformation, the article or structure may be restored to its original form or configuration by heating the part just above the transformation temperature. For example, eyeglass frames including temple and nose pieces, as disclosed in copending and commonly owned U.S. application Ser. No. 876,077 filed June 19, 1986, the disclosure of which is incorporated herein by reference, may be constructed using such shape-memory alloy as at least the reinforcing members for such frames. Such spectacles are not only more comfortable to wear, but also are immediately restorable to their original form merely by immersion in hot water say 120° F. if dropped or inadvertently deformed during wear.

However, in prior known devices, the shape of the device in the austenitic state of the shape-memory alloy corresponds to a desired shape when the device is built and heretofore has required replacement or remanufacture to give an article a different shape in its austenitic state. The alloy is highly resistant to mechanical reshaping after it passes from the martensitic to the austenitic state. Apparatus of the present invention is directed to means for reshaping articles, or portions of articles, quickly and easily without such mechanical reworking of the article to provide a new austenitic state. Accordingly, eyeglass frames or other personal wear items, such as shoes, orthodontic braces, partial dental plates or inner or outer clothing that require reinforcing elements may be readily conformed to the wearers individual anatomy or fashion at the point of use. The apparatus is also particularly useful in shaping or reshaping hand-held tools, or other implements, such as surgical clamps, scalpels and the like to the user's desire or need.

DESCRIPTION OF THE PRIOR ART

It is known to heat plastic eyeglass frames including embedded metal rods to conform to a wearer's head configuration. This includes adjusting the length and tilt of the temple pieces and the frame nose pieces so that the spectacles rest comfortably and securely on the wearer's ears and nose. Since commercial eyeglass frames are normally made of metal or plastic in a few standard widths and lengths, it is necessary to fit each pair of glasses to the wearer. The glass frame is, unfortunately, easily bent or twisted beyond the material yield point to configure it for the wearer's comfort. Where made of thermoplastic, the frame or temple pieces are normally immersed in a bed of heated glass beads, or particles. As disclosed in U.S. Pat. No. 4,054,376—WAREHAM, the frame may also be so heated by blowing hot air through the glass beads. The beads may be on the order of 10 to 30 mesh (approximately 0.065–0.02 inch diameter). In such an arrangement the beads are relatively loose so that the glass frame, including the temple pieces, can be submerged in the heated particles. Adjustment is then by hand manipulation after the heated frames are sufficiently soft to deform yieldably and before the frame cools to its newly set condition. A similar arrangement for adjusting optometric frames is disclosed in U.S. Pat. No. 3,329,801—SHANNON ET AL.—wherein the spectacle frame is heated on an endless belt by hot air blowing over it. Both patents disclose the same arrangement for adjusting the frames.

It also has been proposed to form eyeglass frames of nickel-titanium directly or as a core beneath a sheath of nickel, chromium or copper as in U.S. Pat. No. 4,472,035—TAKAMAURA ET AL. However, no provision for conforming or fitting the frame is disclosed. Accordingly, the patentees do not teach or suggest conversion of such alloy from its martensitic state to the austenitic state of the frame so that the wearer can readily recover the like-new shape if during normal wear in the martensitic state the frame becomes deformed. This would be done by merely raising the temperature to the transition point, say 120° F.

It has also been known to heat treat, or anneal, steel castings or the like in a bed of hot fluidized particles. The particles are heated by air or gas flowing over and around the article to be treated. Heat is carried and transferred from the particles, such as sand, to an article under treatment, so that it is either heated or held at a given temperature. The particles may be consolidated around the article by decreasing the gas flow and application of vacuum or vibration. U.S. Pat. No. 4,249,889—KEMP, discloses a system in which heated particles are levitated by air flow. The particles are then compacted around the article by vacuum. U.S. Pat. No. 4,410,373—KEMP, discloses a similar arrangement in which the particles are settled or compacted by vibration.

U.S. Pat. No. 4,314,790—METZ, discloses a similar system, using expanded vermiculite to hold the temperature of hot steel ingots or slabs, while they are being moved from one location to another. The particles are fluidized by gas and then permitted to settle around the ingot or slab as insulation.

Additionally, it is also known to use fluidized particles for cooking food without water or pressure by positioning the article to be cooked, such as cans, within a bed of heated particles. Such a system is disclosed in U.S. Pat. No. 3,118,773—BENNETT ET AL.

It is also known to hold a workpiece while it is drilled or otherwise formed. For example, in U.S. Pat. No. 3,604,700—GAULT, a workpiece is held by a plurality of parallel rods confined within a circular or square jig. The rods are either squeezed radially or longitudinally by a plurality of balls that are locked by a screw, bolt or other compression means so that rods generally conform to an uneven surface to hold the piece while it is drilled, or otherwise worked on.

U.S. Pat. No. 3,180,636—CARPENTER, discloses a similar clamping arrangement to permit machining of a brittle article or the like. A rubber grommet around the workpiece squeezes the article radially in response to axial forces on the grommet.

U.S. Pat. No. 3,540,718—HEFFRON ET AL., discloses a jig for temporarily holding a plurality of circuit board components so that their connecting leads evenly protrude through printed circuit board holes. A sponge pad is cut into a plurality of contiguous, deflectable fingers which hold the components of different shapes and sizes against the board.

None of the above-noted patents propose an apparatus for confining a whole or a part of a shapememory alloy object, such as lens frames, so that such parts, manufactured as standard or mass-produced articles, may be readily adjusted or readjusted to fit or suit the feel preference of an individual wearer at or near the point of fitting. More importantly, none discloses that such a personally readjustable fit can be maintained by the wearer without frequent (and inconvenient) return to the optometrist's offices to have the frames of the spectacles refitted after inadvertently dropping or deforming them. Such fit is readily restored by simply raising the temperature above the transformation temperature for such shape-memory alloy to return to its new austenitic state. In general such memory state may be readily restored by immersion in moderately hot water, say less than 120° F., as in daily normal use of hot water to clean the glasses or lenses. Furthermore, none discloses an apparatus for conforming any article requiring such custom adjustment so that it can be re-configured repeatedly in its martensitic state by constraining it within a bed of particles in that configuration and then heating either the complete article or only the portion that is to be reshaped within the bed, to the heat treatment temperature of the shape-memory alloy. Preferably such heat is generated by using the relatively high electrical resistance of such shape-memory alloy forming the article.

SUMMARY OF THE INVENTION

In accordance with an important aspect of the present invention, apparatus is provided to mold a shape-memory alloy part into a given configuration in an austenitic state from substantially the same configuration given to the part in its martensitic state. The apparatus includes an enclosing chamber having an access opening to receive at least a shape-memory alloy portion of a part, the portion having a given configuration to be converted from such new configuration in its martensitic state to the same configuration in the austenitic state. The enclosure chamber is adapted to surround and confine such article portion within a body of solid particles substantially smaller than the article portion so that the particles within the chamber conform generally to the given configuration of the article. At least one pressure member applies an immobilizing pressure to the body of particles around the shape memory-alloy portion so that further deformation of the portion from said given configuration will not occur; and means for transferring sufficient heat directly to the settable portion to reset its shape memory while the portion is held in substantially the same configuration as the configuration given to the portion in its martensitic state during transformation through any original austenitic state to the treatment temperature to set the new austenitic state.

In a preferred form such heat is generated by reactive current flow induced in the selected portion of the part; most preferably direct or alternating current is connected across the part or article embedded in the bed of particles so that such current flows resistively through the part. In this way advantage is taken of the relatively high electrical resistance of the alloy itself to generate such heat setting temperature internally. Alternatively, alternating current flow in the part may be created by inductive or capacitative coupling to the part through the body of particles.

In a preferred form the enclosure chamber is a rectangular box and the pressure member forms a closure cover for the box. If desired the enclosure chamber filled with particles may be confined within a larger rectangular box.

Alternatively, the enclosure chamber may be a cylindrical bore and the pressure member may be a piston axially reciprocable in the bore.

Further objects and advantages of the present invention will become apparent from the description of the preferred embodiments taken with the drawings which form an integral part of this specification.

DESCRIPTION OF THE PREFERRED EMBODIMENTS

Figure 1:
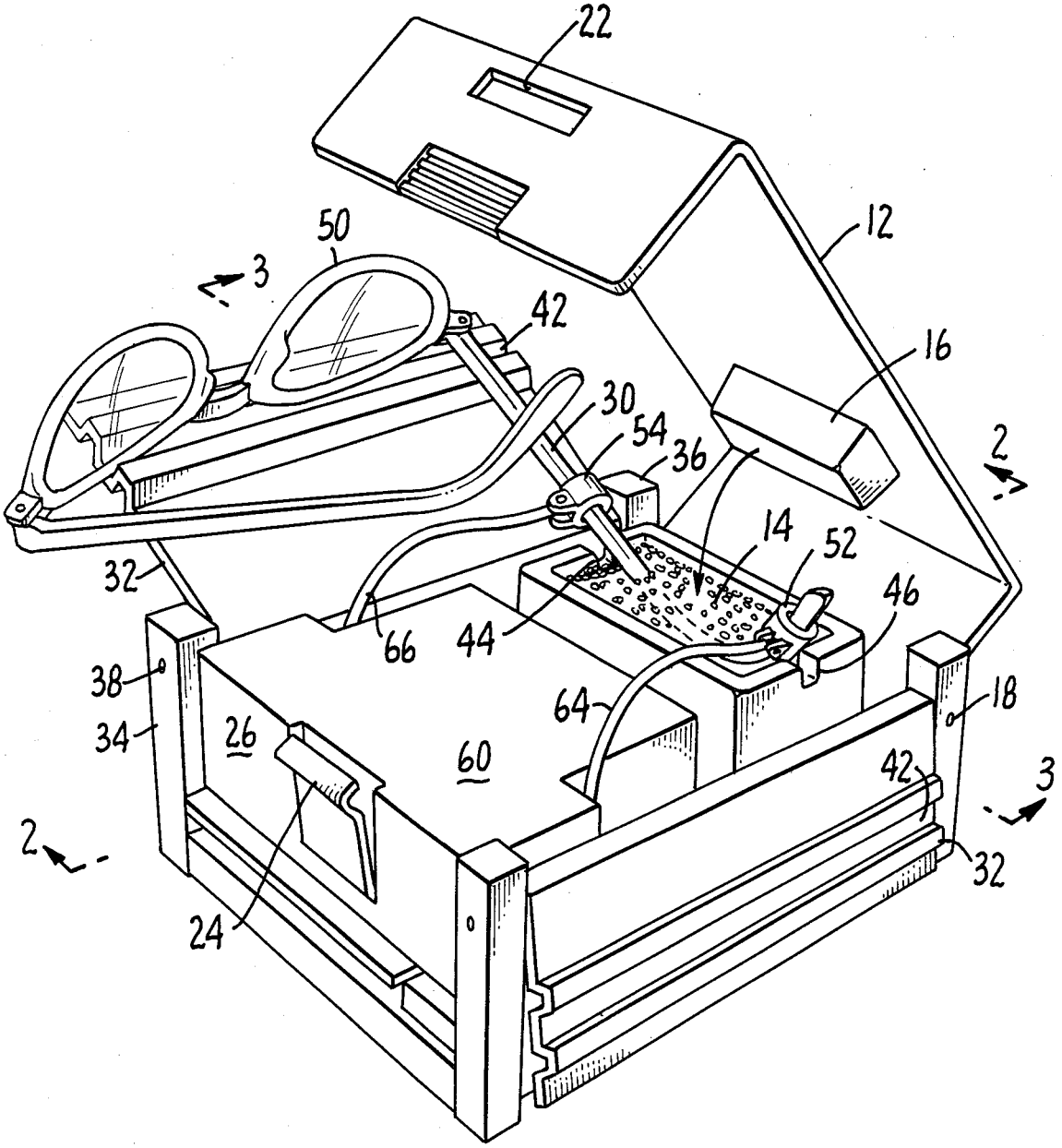
FIG. 1 is perspective view of a preferred form of apparatus suitable for carrying out the present invention in which the shape-memory alloy portion of an article such as a portion of a temple piece of a pair of eyeglasses is to be set to a new memory shape. The temple and ear portion of the temple piece is adapted to be embedded in a body of particles or powder within a box having a molding compartment in which particles surrounding the piece are compressed by a piston member forming a part of the cover. The figure also illustrates an arrangement to apply electrical current directly to the piece after it is shaped or reshaped to a given configuration of the piece as formed in its martensitic state and while the piece is restrained from returning to its previous memory shape (if it has been given a previous memory shape) until the temperature of the part is substantially above the transformation temperature in the austenitic state. The current is applied for sufficient time to heat the piece enough to permanently set the new memory shape of the shape-memory alloy portion to substantially the same configuration given to said portion in said martensitic state.

Referring now to the drawings and in particular FIG. 1, there is illustrated one form of apparatus suitable for carrying out the present invention. It comprises generally box 10 forming an enclosing chamber for supporting a body of solid particles 14 in a trough member 11 adapted to receive and embed a shape-memory alloy article such as temple piece 30 of a pair of glasses 50. Particles 14 may be a fine grained-powder or sand, rock salt or glass beads of relatively small diameter, say from a few thousandths to a few tenths of an inch in diameter. Particles 14 surround and immobilize at least a reshaped portion of temple piece 30 when cover 12 of box 10 is closed and integral piston member 16 compacts bed of particles 14 around piece 30. Preferably the particle material has relatively low heat conductivity and in the present embodiment is preferably electrically non-conductive, so that the shape-memory alloy piece may be directly heated by any suitable electrical current, e.g. D.C. or A.C. from low to microwave frequencies, including sinusoidal or pulsed wave trains.

By piston 16 compressing particles 14, a newly shaped temple piece 30 is constrained to retain its new shape, into which it was easily deformed and shaped in the martensitic state due to the alloy's low strength yieldability and malleability. After being shaped in the martensitic state of the alloy, the piece will return to its original non-deformed shape in the austenitic state unless the reshaped part is restrained along and around such part during the time heat is being increased to a temperature sufficient to reset the internal, crystalline structure of the shape-memory alloy element. Such setting temperature is substantially above the transformation range between the martensitic and austenitic states of the metal, and may be on the order of 300° C.

Figure 2:
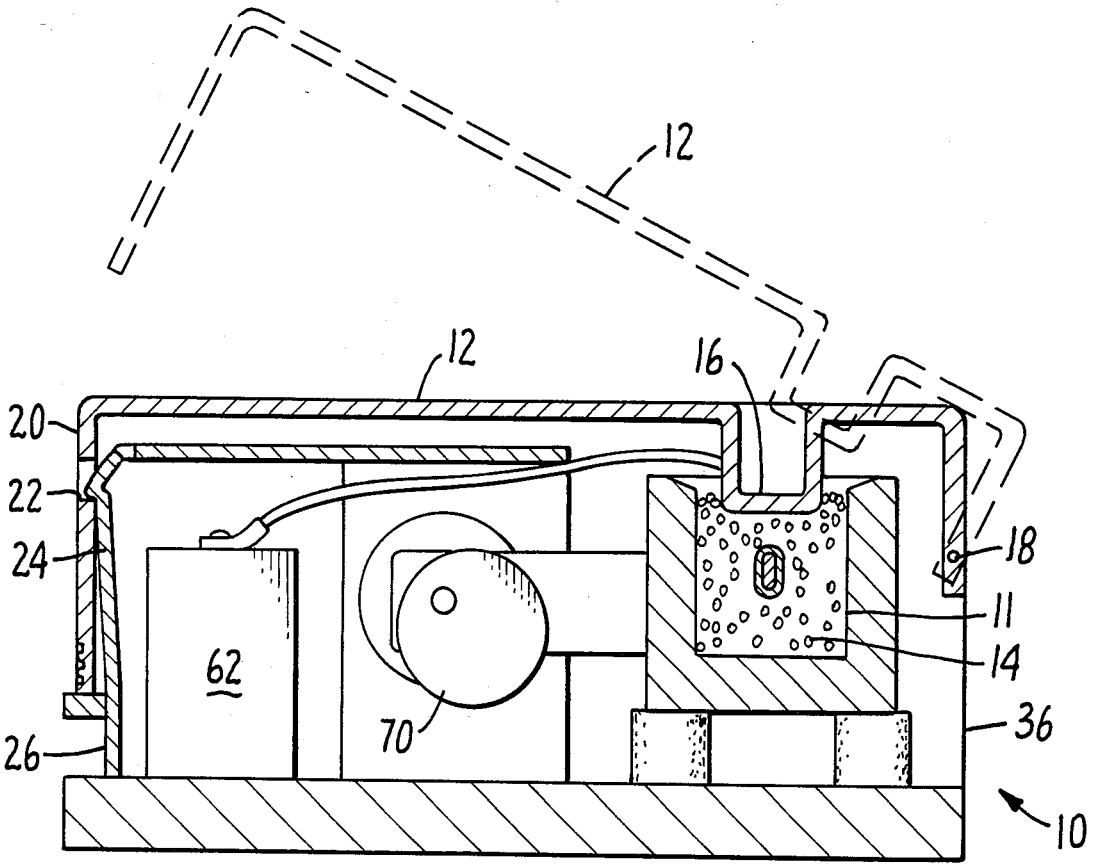
FIG. 2 is a elevation cross-sectional view taken in the direction of arrows 2—2 in FIG. 1 illustrating engagement and disengagement of the cover and the pressure applying means for immobilizing particles in the bed with a shape-memory alloy portion embedded therein and means for supplying heat as well as vibration means to loosen the particles for easy insertion or removal of the temple piece from the particle bed.
Figure 3:
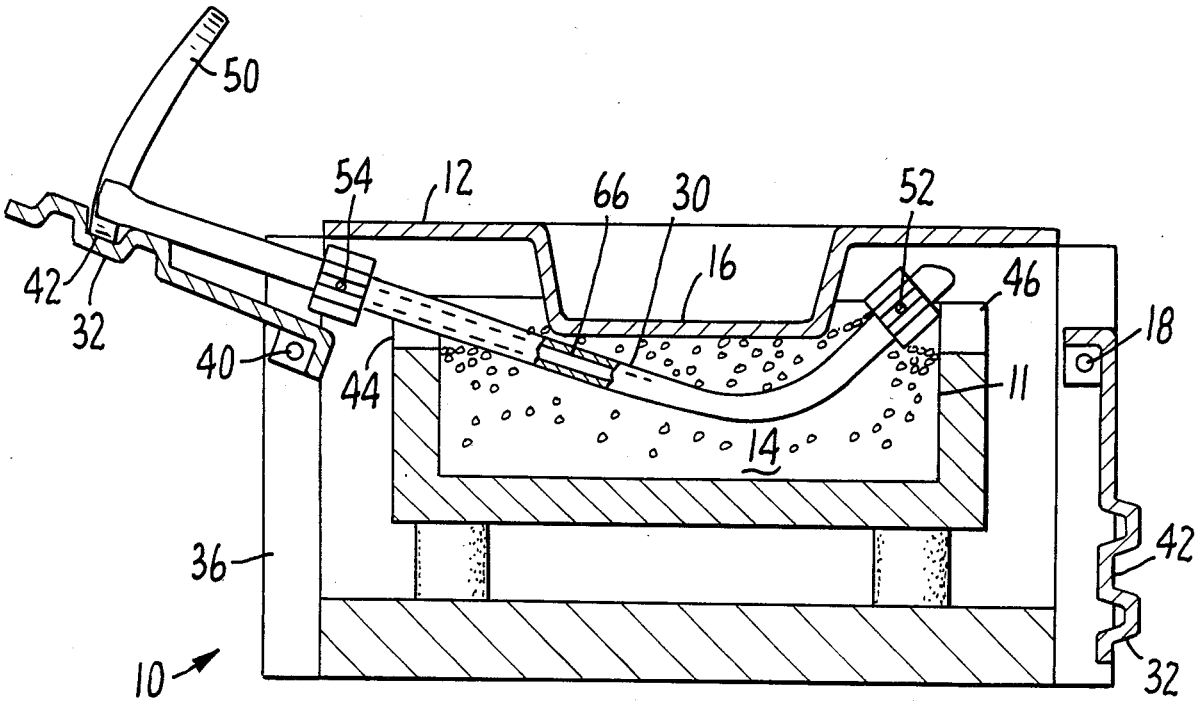
FIG. 3 is an elevation cross-sectional view taken in the direction of arrows 3—3 illustrating the temple piece, supported in the moldable bed of confining particles so as to hold the shape of the temple piece during transformation of the metal from its set martensitic state to its austenitic state.

With further reference to FIG. 1, cover 12 forms a safety enclosure both for the top of box 10 and for trough 14 through pressure foot, or piston member 16, secured to the inside of cover 12. Cover 12 pivots on hinge pins 18, so that plunger 16 applies pressure directly to the top of the bed of particles 14 in trough 11. This is best seen in FIGS. 2 and 3 wherein trough 11 is shown in cross-section both in front elevation, as in FIG. 3 and in end elevation as in FIG. 2. As also indicated, lid or cover 12 includes a front locking portion so that when piece 30 is being heated to above 300° C. there is no direct user access to the temple pieces or the particle bed. For this purpose slot 22 in lip 20 mates with catch member 24 carried by front wall 26 of box 10. The locked position of lid 12 holds pressure foot 16 so that it compacts particles 14 to mold around temple piece 30 of a pair of glasses 50 and thereby prevents the embedded portion of temple piece 30 from returning to its previous shape in the austenitic state and holds the temple piece immobilized during the time the crystalline structure of shape-memory alloy portion is being reconditioned to assume the desired memory shape.

As also shown in the arrangement of FIG. 1, eyeglass frame 50 may be supported by a side flap member 32 pivoted at the front and rear corners 34 and 36 of box 10 on pins 38 and 40 respectively. For convenience each side flap 32 includes molded track 42 to support glass frame 50 on either the left side or right side of box 10, as viewed facing front panel 26. In FIGS. 1–3 a left temple piece 30 is positioned by placing the eyeglass frame 50 in track 42 of left side flap 32 so that piece 30 extends into trough 11 at an angle such that it is embedded in the particles 14.

The temple piece is further accommodated by slots 44 and 46 in the edges of trough member 11 and tipped in such a position that the temple piece, especially the portion passing over an ear of wearer, is well within the particle bed but with the outer tips and hinge end of the temple piece exposed for engagement by electrical connectors 52 and 54. In the present embodiment the front portion 60 of box 10 may include a power source indicated generally as a transformer or battery 62 in FIG. 2. Desirably the source is capable of delivering low-voltage, high-current power through leads 64 and 66 to connectors 52 and 54 respectively.

Further in accordance with the present invention, advantage is taken of the relatively high internal resistance of shape-memory alloys, and particularly those of Nitinol an alloy of nickel and titanium. Nitinol has a high coefficient of resistance similar to nickel-chrome, as used in space heater elements. Thus, in relatively short periods of high current flow the temperature of the portion electrically coupled to the power source rises to over 300° C. and, thereby quickly sets the new crystalline structure of the shape-memory alloy in its new shape in the austenitic state.

In general, it is understood that the apparatus of the instant invention is useful for setting and resetting any shape-memory alloy part and is not limited to Nitinol as numerous alloys are known which exhibit the shape-memory effect.

In the present embodiment the electrical connections create such current flow directly through the temple piece. Such connection may be made by pinpoint contacts as through connectors 52 and 54 adapted to extend through the plastic overcovering 66 on temple piece 30 to contact directly the shape-memory alloy, serving as a reinforcing member within the plastic temple piece 30. Alternatively, of course, the temple piece may be formed directly of a shape-memory alloy. In such case, the contact need only be sufficiently secure to transmit adequate current to raise the temperature of the temple piece in the section between electrodes 52 and 54 substantially above the transformation range in which the shape-memory alloy is transformed to its new shape in the austenitic state from its martensitic state. The power from source 60 may be an alternating transformer secondary. Electrodes 52 and 54 may then be either capacitively or inductively connected to temple piece or reinforcing piece 66 so that reactive current flows through the shape-memory alloy portion. Thus, current flow through piece 30 may be by any of the modes of reactive flow, namely resistance, capacitance, or inductance. With alternating current flow, particles 14 around temple piece 30 are desirably electrically non-conductive.

It is also envisioned that heat may be applied to the shape-memory alloy portion after it is clamped by flowing a hot fluid through the particles 14. This fluid might be hot oil or a hot gas, for example. It is additionally considered that the particles 14 themselves may be heated such as in the case of their being made of ferrite material subjected to an induction field and would then heat the shape-memory alloy portion by conduction. Other means for heating the area around said particles or heating the particles themselves are within the scope of the invention.

In the arrangement illustrated in FIG. 1–3, it will be apparent that side supports 32 and 42 will be raised into their frame support position (as illustrated on the left side of FIG. 1) so that in the elevated position, the opening through the side of the box is adequate to permit a temple piece, such as the left-hand temple piece, to extend into the bed particles 14 without interference.

For adjustment of the right temple piece the side support 42 may be raised and the right hand temple piece inserted from the right hand side of the box as viewed in FIG. 1.

If desired, a slight flow of air (not shown) sufficiently low to prevent substantial displacement of particles 14 from trough 11 may be used to slightly levitate the particles. This permits the part to be removed from or embedded in the particles after the clamping force is removed. Additionally, such air flow may be used to cool the reset part more rapidly after heating. Further, while not shown, it will be apparent that bed of particles 14 may be sufficiently large to encompass any desired portion, or all of an article, to be reshaped to a new memory state, i.e., in setting other body support or shaped elements. To assist insertion or removal of the shape-memory alloy part particles 14 may be vibrated by an external vibrator 70, in the form of a solenoid, or as shown by motor 72 driving an eccentric weight arrangement 74. Vibrator 70 mechanically shakes particles 14 to aid in reducing the force required to insert the part into the bed to avoid further deformation of the part prior to application of heat by the electrodes. It will also be apparent that the electrodes may be within the body of particles if the part so requires.

From the foregoing it will be understood that any shape-memory alloy part that requires setting or re-setting after manufacture may be reset by the apparatus of the present invention to conform to a particular individual's personal use. Various adaptations in the embedding chamber and the form of the particles, as well as the pressure-applying means, may be made without departing from the scope of the present invention. For example, the enclosing chamber may be formed as a cylinder and the clamping or restraining means for compressing beads or powder around the article formed as a piston reciprocable in the cylinder bore.

It should also be considered that pressure may be applied to the chamber by pneumatic or hydraulic means (not shown). One or more walls of the chamber may be a membrane (e.g., similar to piston 16 or forming a wall of member 11) which can be deformed to apply pressure on the body of particles, or a bladder could be included within the chamber full of particles such that after closing the lid the bladder could be pumped up (expanded in volume) to apply pressure on the particles in the chamber.

Other modifications and changes in the apparatus for carrying out the present invention will become apparent to those skilled in the art from the foregoing description. All such modifications or changes coming within the scope of the appended claims are intended to be included therein.

I claim:

1. Apparatus for resetting a portion of a part formed of shape-memory alloy having a martensitic state and an austenitic state, the portion capable of being deformed to a customized configuration from an original configuration while the alloy is in the martensitic state and capable of recovering from the customized configuration to the original configuration when the alloy is heated to the austenitic state, the apparatus comprising:

an enclosing chamber having an access opening therein to receive at least a portion of a part formed of shape-memory alloy, such a portion being deformed from an original configuration to a customized configuration in the martensitic state of the alloy, such a portion to be reset to the same configuration in the austenitic state of the alloy, said enclosure chamber being adapted to surround and confine such a portion therein;

a body of unconsolidated solid particles adapted to conform generally to such a customized configuration of a portion within said chamber;

at least one pressure member for closing said access opening and applying a localized immobilizing pressure to said body of particles to compress the particles around a portion having a customized configuration without further deformation of such a portion from such a configuration and to clamp and restrain such a portion from recovering to any previous original configuration when in the austenitic state of the alloy; and means for directly heating such a portion to elevate the temperature of such a portion to at least the austenitic setting temperature of the alloy to reset such a portion to substantially the customized configuration given to said portion in the martensitic state of the alloy.

2. Apparatus in accordance with claim 1 wherein said means for heating comprises electric current transfer means including at least a pair of electrodes within said enclosing chamber connectable at opposite ends of said portion within said body of particles.

3. Apparatus in accordance with claim 1 wherein said enclosure chamber is a rectangular box and said pressure member forms a portion of the closure cover for said box.

4. Apparatus in accordance with claim 1 including a power source having at least a pair of electrodes, said electrodes being connectable to at least two spaced-apart locations on said portion and means for actuating said source in response to closure of said cover of said box.

5. Apparatus in accordance with claim 3 with the addition of vibration means for shaking said bed of particles for insertion and removal of said portion from said bed.

6. Apparatus in accordance with claim 1 wherein said pressure member is a membrane capable of being deformed to apply a uniform pressure over the body of solid particles in said chamber.

* * * * *